US006039202A

United States Patent [19]

Olstad et al.

[11] Patent Number: 6,039,202

[45] Date of Patent: Mar. 21, 2000

[54] COOLER INSERT SYSTEM

[76] Inventors: Todd Olstad; Marvel Olstad, both of P.O. Box 747, New Glarus, Wis. 53574

[21] Appl. No.: 08/984,707

[22] Filed: Dec. 3, 1997

[51] Int. Cl.[7] ..... B65D 25/06

[52] U.S. Cl. ..... 220/533; 220/528; 220/23.88; 220/7

[58] Field of Search ..... 220/533, 532, 220/529, 501, 528, 23.83, 23.86, 23.87, 23.88, 23.9, 23.91, 592.01, 592.15, 4.34, 4.29, 4.28, 7, 485, 486, 691; 206/514

[56] References Cited

U.S. PATENT DOCUMENTS

| | | | |
|---|---|---|---|
| 1,315,067 | 9/1919 | Woodworth | 220/7 |
| 2,627,993 | 2/1953 | Hafner | 220/533 |
| 2,635,779 | 4/1953 | Pfeiffer | 220/23.88 |
| 3,069,002 | 12/1962 | Hart | 220/533 |
| 4,759,467 | 7/1988 | Byrne | 220/528 |
| 4,781,300 | 11/1988 | Long | 220/7 |
| 4,787,532 | 11/1988 | Borjesson | 220/528 |
| 4,813,243 | 3/1989 | Woods et al. | 62/381 |
| 4,819,793 | 4/1989 | Willard et al. | 206/162 |
| 4,872,589 | 10/1989 | Englehart et al. | 220/528 |
| 4,899,553 | 2/1990 | Drummond, III | 62/372 |
| 4,901,876 | 2/1990 | Box | 220/533 |
| 5,042,260 | 8/1991 | George, Sr. | 62/60 |
| 5,119,950 | 6/1992 | Takemura | 220/533 |
| 5,143,246 | 9/1992 | Johnson et al. | 220/23.83 |
| 5,215,208 | 6/1993 | Jackson | 220/516 |
| 5,421,172 | 6/1995 | Jones | 62/457.5 |

*Primary Examiner*—Stephen Castellano
*Attorney, Agent, or Firm*—Joseph N. Breaux

[57] ABSTRACT

A cooler insert system that includes an open-sided, main frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box with the main frame structure; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

12 Claims, 2 Drawing Sheets

COOLER INSERT SYSTEM

TECHNICAL FIELD

The present invention relates to accessories for coolers, ice chests and the like and more particularly to a cooler insert system that is insertable into the storage compartment of a cooler, ice chest or the like for organizing items; the cooler insert system including a main, open-sided, frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

BACKGROUND ART

Coolers, ice chests and the like type storage articles that provide a storage compartment for items are used by many people to keep various food and drink items cool for a short period of time. Although the storage compartment within these storage articles typically provide an adequate volume for holding the desired items, it is often difficult for a user to maintain the items in an organized fashion within the storage compartment. It would be a benefit, therefore, to persons using such coolers, ice chests and the like type articles to have an insert system that was insertable into the storage compartment that included a frame structure that could be configured by the user into a number of insert compartments for separating various items from each other within the storage compartment. In addition, because it is often desirable to keep a number of items separated from each other, it would be a further benefit to have an insert system that included a number of stackable trays that each included a holding cavity that was sealable by placing another stackable tray on top.

GENERAL SUMMARY DISCUSSION OF INVENTION

It is thus an object of the invention to provide a cooler insert system that is insertable into the storage compartment of a cooler, ice chest, or the like type storage article that includes a frame structure that can be configured by the user into a number of insert compartments for separating various items from each other within the storage compartment.

It is a further object of the invention to provide a cooler insert system that includes a number of stackable trays that each included a holding cavity that is sealable by placing another stackable tray on top.

It is a still further object of the invention to provide a cooler insert system that includes an open-sided, main frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box with the main frame structure; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

It is a still further object of the invention to provide a cooler insert system that accomplishes some or all of the above objects in combination.

Accordingly, a cooler insert system is provided. The cooler insert system includes an open-sided, main frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box with the main frame structure; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
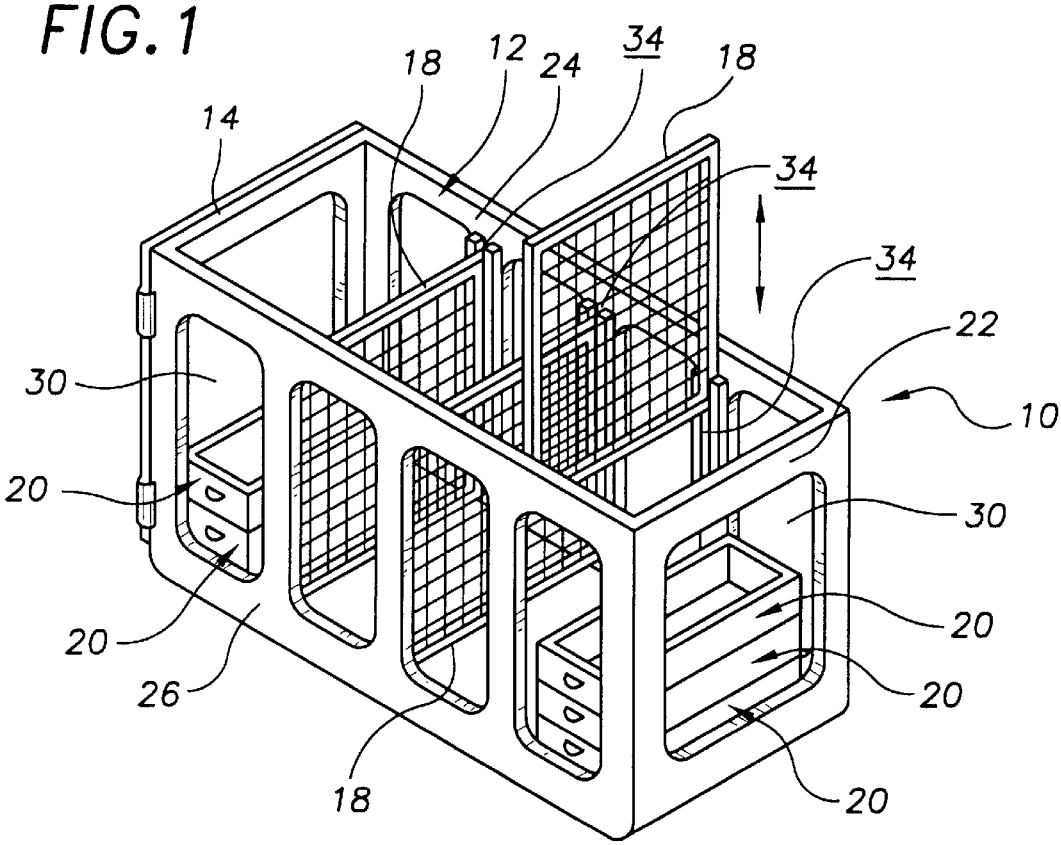
FIG. 1 is a perspective view of an exemplary embodiment of the cooler insert system of the present invention showing the main open sided, frame structure including three of the six divider screen guide channels; the snap fit, hinged frame panel snap fit to the ends of the two frame structure panels; the three divider screens inserted into the six divider screen channels of the main frame structure dividing the main frame structure into four compartment areas; and the five stackable trays, stacked within two of the four compartment areas.

FIG. 1 shows an exemplary embodiment of the cooler insert system of the present invention generally designated by the numeral 10. Cooler insert system 10 includes a molded plastic, open sided, main frame structure, generally designated 12; a molded plastic, snap fit, hinged frame panel 14; three molded plastic, divider screens 18; and five stackable trays, generally designated 20. Main frame structure 12 includes an end wall 22 and two opposed side walls 24,26. End wall 22 and opposed side walls 24,26 each have at least one opening 30 formed therethrough for allowing circulation of ice and cold water in use.

Opposed side walls 22,24 have three pairs of divider screen guide channels 34 (remaining guide channels 34 shown in FIG. 3) within which the side edges of divider screens 18 are inserted to divide the open top box, formed when snap fit, hinged frame panel snap 14 is snap fit to main frame structure 12, into user sized insert compartments.

Figure 2:
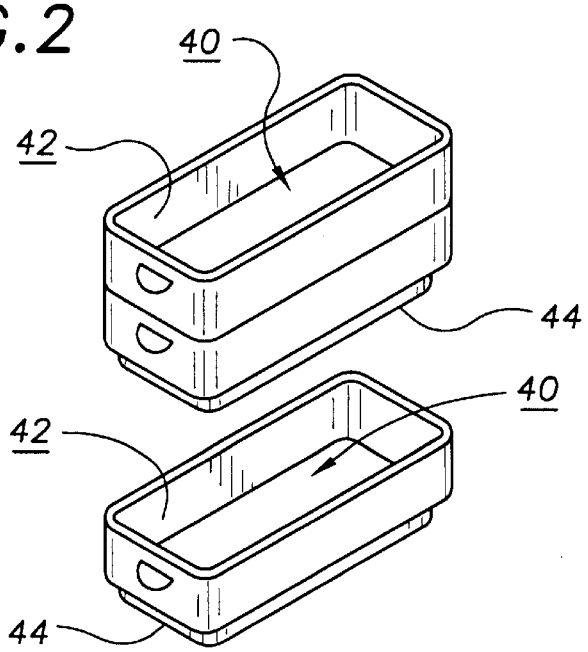
FIG. 2 is an exploded perspective view of three of the stackable trays in isolation showing two of the item holding cavities and two of the lower registration protrusions, the registration protrusions being sized to sealing fit into the opening of a holding cavity in a manner to form a seal for the holding cavity.

With reference to FIG. 2, stackable trays 20 are of identical molded plastic construction. Each stackable tray 20 includes a holding cavity 40 defined therein that is accessible through an access opening 42 and also includes a lower registration protrusion 44 that extends from the bottom of the stackable tray 20. Each lower registration protrusion 44 is sized and shaped to sealing fit into an access opening 42 of a holding cavity 40 of another tray member 20 to seal the access opening 42 and holding cavity 40.

Figure 3:
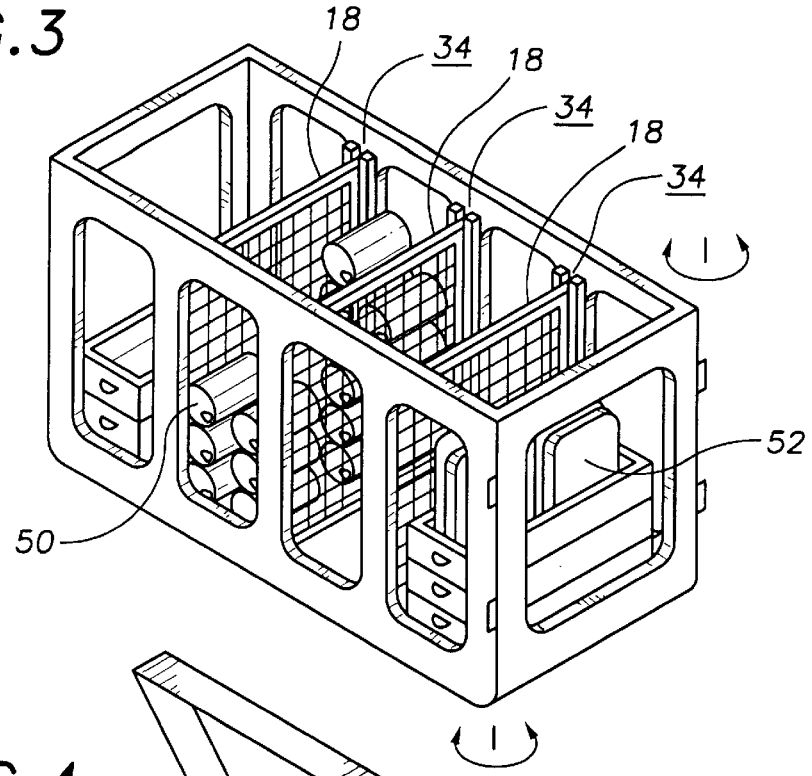
FIG. 3 is a second perspective view of the exemplary cooler insert system of FIG. 1 with a number of food and drink items inserted into the compartments of the frame structure and holding cavities of the stackable trays.
Figure 4:
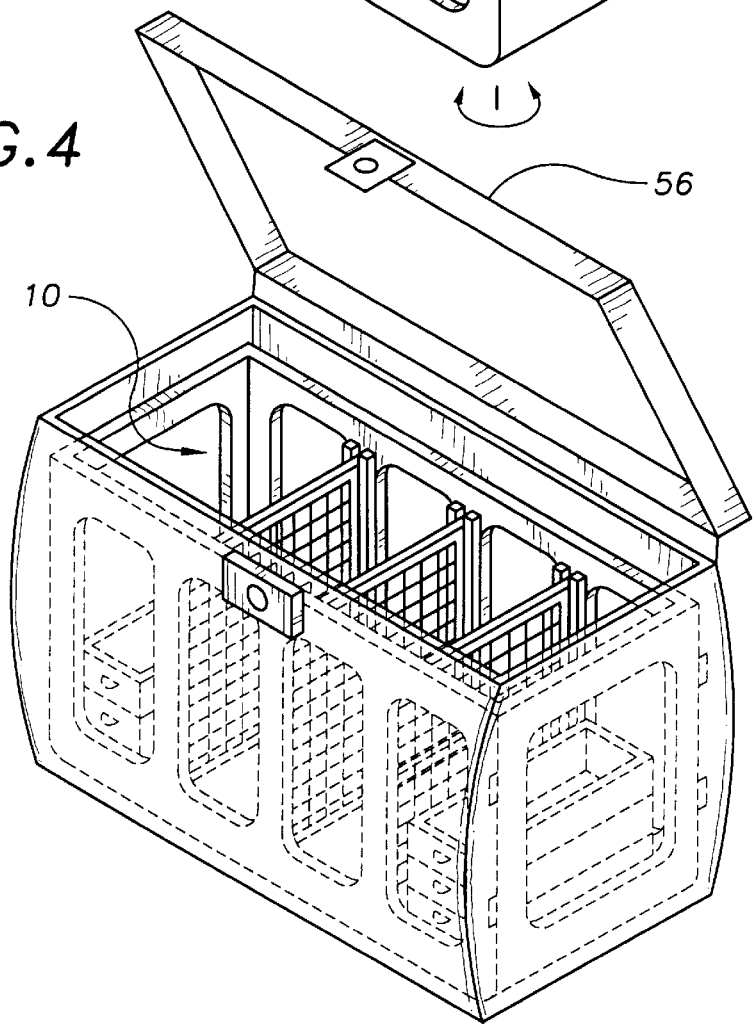
FIG. 4 is a perspective view showing the cooler insert system of FIG. 1 inserted into the cooler compartment of a conventional hinged top cooler.

FIG. 3 shows a number of items such as canned beverages 50 and sandwiches 52 positioned within insert compartments defined by divider screens 18. FIG. 4 shows cooler insert system 10 inserted within the storage compartment of a representative cooler 56.

It can be seen from the preceding description that a cooler insert system has been provided that is insertable into the storage compartment of a cooler, ice chest, or the like type storage article that includes a frame structure that can be configured by the user into a number of insert compartments for separating various items from each other within the storage compartment; that includes a number of stackable trays that each included a holding cavity that is sealable by placing another stackable tray on top; and that includes an open-sided, main frame structure including an end wall and two opposed side walls, the end wall and the two opposed side walls each having an opening formed therethrough, the two opposed side walls having three pairs of divider screen guide channels; a snap fit, hinged frame panel that is simultaneously snap fittable to an end of each of the two opposed sidewalls of the frame structure to form an open topped box with the main frame structure; three divider screens, each divider screen being insertable into one pair of the three pairs of divider screen guide channels of the main frame structure to divide the interior of the main frame structure into compartments; and a number of stackable trays that are positionable within a compartment formed by one of the divider screens, each stackable tray having a holding cavity defined therein that is accessible through an access opening and a lower registration protrusion extending from the bottom thereof; the registration protrusion being sized and shaped to sealing fit into the access opening of a holding cavity of another tray member and to seal the access opening into the holding cavity.

It is noted that the embodiment of the cooler insert system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A cooler insert system comprising:

an open-sided, main frame structure including an end wall and two opposed side walls, said end wall and said two opposed side walls each having an opening formed therethrough, said two opposed side walls having three pairs of divider screen guide channels;

a snap fit, hinged frame panel that is simultaneously snap fittable to an end of each of said two opposed sidewalls of said frame structure to form an open topped box with said main frame structure; and three divider screens, each divider screen being insertable into one pair of said three pairs of divider screen guide channels of said main frame structure to divide said interior of said main frame structure into insert compartments.

2. The cooler insert system of claim 1 wherein:

said main frame structure and said snap fit, hinged frame panel are of molded plastic construction.

3. The cooler insert system of claim 1 wherein:

each of said divider screens is of molded plastic construction.

4. The cooler insert system of claim 1, further including:

a number of stackable trays that are positionable within a compartment formed by one of said divider screens, each stackable tray having a holding cavity defined therein that is accessible through an access opening and a lower registration protrusion extending from said bottom thereof.

5. The cooler insert system of claim 4, wherein:

said registration protrusion is sized and shaped to sealing fit into said access opening of a said holding cavity of another said tray member and to seal said access opening into said holding cavity.

6. The cooler insert system of claim 2 wherein:

each of said divider screens is of molded plastic construction.

7. The cooler insert system of claim 2, further including:

a number of stackable trays that are positionable within a compartment formed by one of said divider screens, each stackable tray having a holding cavity defined therein that is accessible through an access opening and a lower registration protrusion extending from said bottom thereof.

8. The cooler insert system of claim 7, wherein:

said registration protrusion is sized and shaped to sealing fit into said access opening of a said holding cavity of another said tray member and to seal said access opening into said holding cavity.

9. The cooler insert system of claim 6, further including:

a number of stackable trays that are positionable within a compartment formed by one of said divider screens, each stackable tray having a holding cavity defined therein that is accessible through an access opening and a lower registration protrusion extending from said bottom thereof.

10. The cooler insert system of claim 9, wherein:

said registration protrusion is sized and shaped to sealing fit into said access opening of a said holding cavity of another said tray member and to seal said access opening into said holding cavity.

11. The cooler insert system of claim 3, further including:

a number of stackable trays that are positionable within a compartment formed by one of said divider screens, each stackable tray having a holding cavity defined therein that is accessible through an access opening and a lower registration protrusion extending from said bottom thereof.

12. The cooler insert system of claim 11, wherein:

said registration protrusion is sized and shaped to sealing fit into said access opening of a said holding cavity of another said tray member and to seal said access opening into said holding cavity.

* * * * *